United States Patent [19]

Fechner et al.

[11] 4,306,936

[45] Dec. 22, 1981

[54] METHOD OF COOLING A FUEL ASSEMBLY-TRANSPORT CONTAINER AND COOLING CIRCUIT FOR PERFORMING THE METHOD

[75] Inventors: Bernd Fechner, Erlangen; Holger Hahn, Dormitz; Pius Mackert, Erlangen, all of Fed. Rep. of Germany

[73] Assignee: Kraftwerk Union Aktiengesellschaft, Mülheim, Fed. Rep. of Germany

[21] Appl. No.: 952,671

[22] Filed: Oct. 19, 1978

[30] Foreign Application Priority Data

Oct. 24, 1977 [DE] Fed. Rep. of Germany ..... 2747601

[51] Int. Cl.[3] ..... G21C 15/60; G21C 19/20

[52] U.S. Cl. ..... 376/272; 376/370; 376/372

[58] Field of Search ..... 250/429, 506, 507; 176/54, 56, 30

[56] References Cited

U.S. PATENT DOCUMENTS

| | | | |
|---|---|---|---|
| 3,046,403 | 7/1962 | Montgomery | 250/507 |
| 3,073,961 | 1/1963 | Nachbar et al. | 250/507 |
| 3,274,065 | 9/1966 | Kierulf et al. | 176/56 |
| 3,445,335 | 5/1969 | Gluntz | 176/54 |
| 3,731,102 | 5/1973 | Peterson | 250/506 |
| 3,851,179 | 11/1974 | Irvine | 250/506 |

FOREIGN PATENT DOCUMENTS

| | | | |
|---|---|---|---|
| 2747601 | 2/1979 | Fed. Rep. of Germany | 250/429 |
| 965751 | 8/1964 | United Kingdom | 250/507 |

*Primary Examiner*—Sal Cangialosi
*Attorney, Agent, or Firm*—Herbert L. Lerner

[57] ABSTRACT

Method of cooling a fuel assembly-transport container with a cooling circuit which includes the interior of the transport container and is traversible by a vaporizable coolant such as water, which includes feeding the coolant to the transport container at the start of the cooling operation at so low a rate that a vapor thereof is formed, withdrawing the vapor from the transport container, and maintaining the cooling through heat-removal by the withdrawn vapor until a reduction in the temperature of the withdrawn vapor occurs, and cooling circuit for performing the foregoing method.

10 Claims, 1 Drawing Figure

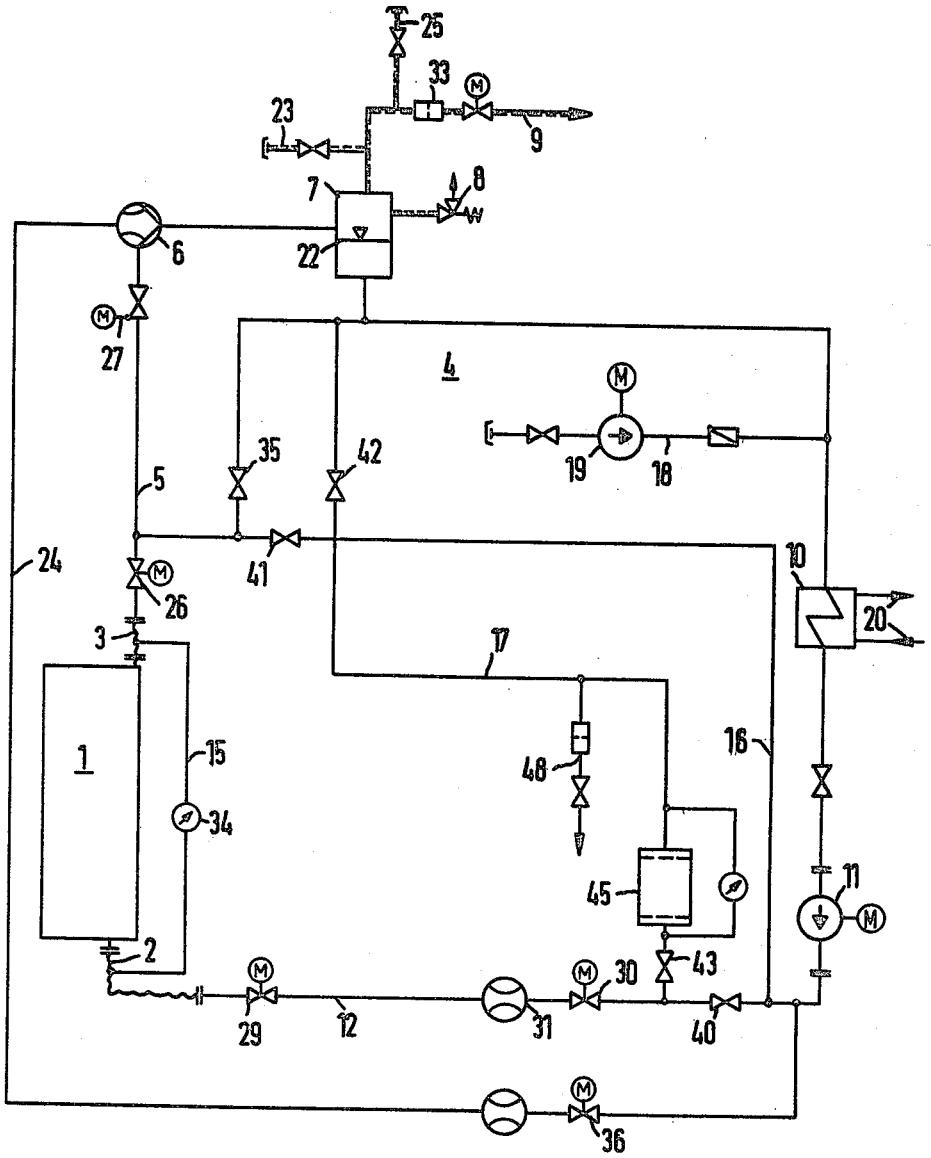
25
33
23
9
7
8
W
6
22
27
4
35
42
19
18
5
41
24
26
10
20
3
17
1
15
48
16
34
45
11
2
43
29
12
31
30
40
36

METHOD OF COOLING A FUEL ASSEMBLY-TRANSPORT CONTAINER AND COOLING CIRCUIT FOR PERFORMING THE METHOD

The invention relates to a method of cooling a fuel assembly-transport container with a cooling circuit which includes the interior of the transport container and is traversible by a vaporizable coolant, such as water, preferably. The invention is further related to a cooling circuit for performing the foregoing method.

With heretofore known water-cooling systems, the temperature of the fuel assemblies is reduced before unloading when the transport container has reached a determination station, usually a reprocessing or repurification installation. In this regard, water is fed to the transport container at one end thereof and withdrawn at the other end thereof without any temperature regulation or control. Cooling should be effected as rapidly as possible, so that the fuel assemblies can be unloaded correspondingly rapidly.The coolant throughput is determined solely by the low "natural" flow resistance of the cooling circuit.

It is accordingly an object of the invention to provide such a method and circuit for cooling a fuel assembly-transport container wherein the cooling operation is so controlled as to prevent damage to the fuel assemblies due to quenching with cold coolant. This is especially important if such fuel assemblies are not to be reconditioned immediately, but rather, are to be supplied to an intermediate storage wherein the damaged fuel assemblies produce a disturbing increase in radioactivity.

With the foregoing and other objects in view, there is provided, in accordance with the invention, a method of cooling a fuel assembly-transport container with a cooling circuit which includes the interior of the transport container and is traversible by a vaporizable coolant, such as water, especially, which comprises feeding the coolant to the transport container at the start of the cooling operation at so low a rate that a vapor thereof is formed, withdrawing the vapor from the transport container, and maintaining the cooling through heat-removal by the withdrawn vapor until a reduction in the temperature of the withdrawn vapor occurs. In this regard, use is made of the fact that the vapor permits cooling to a considerably higher level and with less specific thermal flux. The temperature level is, moreover, well controllable through the pressure prevailing in the cooling system. The cooling circuit is therefore preferably operated under an elevated pressure of up to 10 atmospheres absolute, in accordance with another feature of the invention.

In accordance with an added feature of the invention, the method comprises withdrawing the vapor with a jet pump from the transport container. This is especially advantageous if the increased pressure prevents free flow of the vapor out of the transport container. In addition, according to the method of the invention, the vaporous coolant is mixed with liquid coolant in the jet pump, free of any disturbance, and without having to fear against any condensation shocks. Since the cooling by vapor generally produces a temperature reduction in a relatively short time, generally, at most in a period of hours, a further cooling of the fuel assemblies can be effected thereafter directly by the liquid coolant. The jet pump can then be shut off. The liquid cooling, that is without vapor development, occurs in a conventional manner for an arbitrary period until it is desired to open the fuel assembly-transport container to unload the fuel assemblies. As a result, a maximal quantity of coolant is introduced into the transport container. Beforehand, however, in accordance with yet another feature of the invention, the method comprises limiting the feed rate of the coolant to the transport container in accordance with the pressure in the transport container. This especially applies to the start of the cooling operation wherein the amount of heat stored in the fuel assemblies would otherwise produce a too rapid and, consequently, too great a vapor development.

In accordance with another feature of the invention, a cooling circuit is provided for performing the method of cooling a fuel assembly-transport container comprising a control device and a coolant supply, the fuel assembly-transport container being connected on one side thereof through the control device to the coolant supply, and a condensation device, the transport container being connected at the opposite end thereof to the condensation device.

In accordance with a further feature of the invention, the condensation device is a coolant-jet pump.

In accordance with an added feature of the invention, the coolant-jet pump is connected to a gas space in a vessel partly filled with the coolant.

In accordance with an additional feature of the invention, the vessel comprises a tangential precipitator connected to the delivery side of the coolant-jet pump.

In accordance with a concomitant feature of the invention, the coolant circuit includes a filter connected to the transport container at the opposite end thereof, and means defining a coolant flow path extending parallel to the condensation device with reversed flow direction in the transport container.

Other features which are considered as characteristic for the invention are set forth in the appended claims.

Although the invention is illustrated and described herein as embodied in method of cooling a fuel assembly-transport container and cooling circuit for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, which is a schematic diagram of a coolant circulatory system for a fuel assembly-transport container for performing the method according to the invention.

Referring now to the FIGURE of the drawing, there is shown therein a transport container 1 connected with the aid of flexible unions or connecting members 2 and 3 into a coolant circulatory system 4. A connecting line 5 extends through a water-jet pump 6 into a venting and deposition vessel 7 which is protected by a safety valve 8 (20 bar) and has a closable vent line 9 leading to a non-illustrated exhaust-gas system.

Coolant (water with feedwater quality) is conducted from the venting vessel 7 into a cooler 10. From a centrifugal pump 11 connected to the cooler 10, a pipeline 12 extends through a flexible connecting member 2 back to the transport container 1.

A controllable by-pass line 15 extends around the transport container 1 to the water-jet pump 6 and from there to the venting vessel 7. The water-jet pump 6 has a suction union that is connected to the union 3 at the transport container 1. Inlet and outlet lines 12 and 5, respectively, of the transport container 1 are connected by two lines 16 and 17 for flow reversal in the container 1 with respective shut-off valves.

A piston or reciprocating pump 19 is installed in a line 18 of an otherwise non-illustrated tank-cleaning system to the cooler 10. The piston pump 19 serves for filling the system 4 and regulating the coolant level. The cooler 10 is connected at the casing side thereof to an intermediate cooling system 20.

With the aid of the piston pump 19, the cooling system 4 is filled with clean water up to a water-level monitor 22 at the venting vessel 7. In a gas space above the water level in the venting vessel 7 is a non-illustrated tangential precipitator or separator. During the filling operation, a vent line 23 above the venting vessel 7 must be opened. Then, the system 4 is vented when the circulating pump 11 is switched on. The water level 22 is maintained with the piston pump 19. The cooling water flows through the line 24 parallel to the container 1.

In case overpressure or excess pressure prevails in the transport container 1 when it is transported into the cooling system 4, the corresponding pressure should be impressed upon the cooling system 4. For this purpose, a nitrogen-connector 25 is provided at the venting vessel 7. In the subsequent flooding operation, an overpressure or excess pressure is developed during the wetting of the very hot fuel assemblies. In addition, the possibility arises, in principle, of selectively prepressurizing the system 4 for this reason. After these preparations, the system 4 is found to be in the following condition:

Circulation only through water-jet pump 6 (about 10 Kg/s), pressure in system 4 almost equal to that in transport container 1, water in system 4 cold (about 35° C., because the cooling system 20 is then also in operation, and in all operating phases, the throughput is constant).

After valves 26 and 27 in the suction line 5 are opened, the pressure in the transport container 1 drops about the level of suction or suction head of the jet pump 6. Valves 29 and 30 in the feed line 12 are opened, a feed rate of about 0.1 kg/s being striven for. The feed rate is determined at a measuring location 31 and is controlled upon demand or requirement. The relative proportions of the flow medium in the lines 12 and 24 is thus initially about 1:100.

At first, the medium fed into the transport container 1 completely vaporizes, the water-jet pump 6, which draws it in, assuring that the maximum quantity of steam resulting therefrom at the rate of production thereof will yet condense in the jet pump 6. The temperature of the driving water increases during this admixing of about 470°-steam (0.1 kg/s) by about 10° C.

The flooding operation can be considerably shortened during the course of cooling by continuously increasing the feed rate into the transport container 1, the instant the steam development and, consequently, the steam temperature decreases. During the flooding operation the level 22 in the venting vessel 7 is held constant, which is accompanied by a pressure increase in the entire circulatory system 4. Controlling the venting into the exhaust-gas system ensures, however, that the system pressure ($P_2$) will not exceed a previously selected value (maximal overpressure in the transport container $1 \leqq 10$ bar during the cooling operation).

The quantity delivered to the exhaust gas system is matched by a throughput-limiting throttle 33 in the venting line 9 to the take-up or admission capacity of the exhaust-gas system. To prevent overfeeding or oversupplying the transport container 1 during the flooding operation, the rate of feed thereto can be throttled through a limiting value for the pressure $P_1$ of the transport container 1.

The instant the temperature at the outlet 3 is located below the saturation temperature related to the pressure $P_1$ and, simultaneously, a liquid-level measuring device 34 indicates that the transport container 1 is full, the water-jet pump 6 can be taken out of service. The feed rate to the transport container 1 is controlled during this cooling operation in accordance with a predetermined maximal temperature gradient $\Delta T_1$/time. The warm water flowing out of the transport container 1 is fed through a valve 35 directly in direction of the venting vessel 7 and the cooler 10. A bypass line 24 is blocked by a valve 36 connected therein, if the full discharge or delivery of the pump 11 is to flow through the transport container.

The coolant flow through the transport container 1, which initially ran in upward direction from below i.e. from the union 2 to the union 3, can be reversed. For this purpose, a valve 40 in the line 12 and the valve 35 are closed. Simultaneously, valves 41, 42 and 43, as shown in the FIGURE, are opened. The cooling water delivered by the pump 11 passes through the pipeline 16 and the valve 41 connected therein to the upper union 3 of the cooling transport container 1. It discharges below through the union 2 from the transport container 1 and flows, then in opposite direction, through the line 12 to the valve 40 connected therein.

In front of the valve 40, the flow branches off and passes through a valve 43 to a filter 45. Activity carriers, such as particles falling off from fuel assemblies, for example, can be detained therein so that a cleaning of the fuel assembly-transport container 1 results.

From the filter 45, the cooling water flows in the line 17 through the valve 42 to the line leading to the cooler 10 and which also communicates with the venting vessel 7.

After exceeding a temperature of 100° C., the system 4 can, during the cooling operation, be completely pressure-relieved by adjusting the limit pressure $P_2$. After a temperature of about 40° to 45° is attained at the outlet to the transport container 1, the latter is separated from the cooling system 4 and, after loosening a few cover screws thereof, is immersed in a nonillustrated fuel-assembly decontamination tank or pit, which contains water which, insofar as is necessary, takes over the further cooling. The system 4 can be emptied through an outlet 48.

We claim:

1. Method of cooling a previously unwetted fuel assembly-transport container in which cooling medium fed thereto would completely vaporize, with a cooling circuit which includes the interior of the transport container and is traversible by a vaporizable coolant such as water, which comprises feeding the coolant to the previously unwetted transport container at the start of the cooling operation at a rate sufficiently slow to effect steam cooling and only allow vapor and not liquid to escape therefrom, withdrawing the vapor from the transport container, condensing the vapor after it is withdrawn from the transport container, and maintaining the cooling through heat-removal by the withdrawn vapor at least as long as a reduction in the temperature of the withdrawn vapor continues.

2. Method according to claim 1 which comprises operating the cooling circuit at an elevated pressure.

3. Method according to claim 1 which comprises limiting the feed rate of the coolant to the transport container in accordance with the pressure in the transport container.

4. Method according to claim 1 which comprises withdrawing the vapor with a jet pump from the transport container.

5. Method according to claim 4 which comprises mixing the vapor in the jet pump so as to completely condense the vapor.

6. Cooling circuit for performing the method of cooling a previously unwetted fuel assembly-transport container in which cooling medium fed thereto would completely vaporize according to claim 1 comprising a control device for feeding coolant through the previously unwetted fuel assembly-transport container sufficiently slowly to effect steam cooling and only allow vapor and not liquid to escape therefrom, a coolant supply, the fuel assembly-transport container being connected on one side thereof through said control device to said coolant supply, and a condensation device, the transport container being connected at the opposite end thereof to said condensation device.

7. Coolant circuit according to claim 6 wherein said condensation device comprises a coolant-jet pump.

8. Coolant circuit according to claim 7 wherein said coolant-jet pump is connected to a gas space in a vessel partly filled with the coolant.

9. Coolant circuit according to claim 8 wherein said vessel comprises a tangential precipitator connected to the delivery side of said coolant-jet pump.

10. Coolant circuit according to claim 6 including a filter connected to the transport container at said opposite end thereof, and means defining a coolant flow path extending parallel to said condensation device with reversed flow direction in the transport container.

* * * * *